US007076974B1

(12) United States Patent
Chen

(10) Patent No.: US 7,076,974 B1
(45) Date of Patent: Jul. 18, 2006

(54) WARP KNITTING FABRIC

(76) Inventor: Tsan-Jee Chen, P.O. Box 215, Taichung (TW)

( * ) Notice: Subject to any disclaimer, the term of this patent is extended or adjusted under 35 U.S.C. 154(b) by 0 days.

(21) Appl. No.: 11/244,338

(22) Filed: Oct. 6, 2005

(51) Int. Cl.
*D04B 21/06* (2006.01)

(52) U.S. Cl. ..... 66/195

(58) Field of Classification Search ..... 66/195, 66/192, 193, 202
See application file for complete search history.

(56) References Cited

U.S. PATENT DOCUMENTS 4,787,219 A * 11/1988 Sato et al. ..... 66/190
5,385,036 A * 1/1995 Spillane et al. ..... 66/87
5,896,758 A * 4/1999 Rock et al. ..... 66/191
6,196,032 B1 * 3/2001 Rock et al. ..... 66/195
6,199,410 B1 * 3/2001 Rock et al. ..... 66/195
6,399,523 B1 * 6/2002 Matsumoto ..... 66/195
6,477,865 B1 * 11/2002 Matsumoto ..... 66/195
6,630,414 B1 * 10/2003 Matsumoto ..... 66/195
6,755,052 B1 * 6/2004 Sytz ..... 66/196

* cited by examiner

*Primary Examiner*—Danny Worrell

(57) ABSTRACT

A contractible two-sided warp knitting fabric structure includes a front base fabric, a rear base fabric, and a connecting yarn coupled with the front and rear base fabrics. The symmetrical front and rear base fabrics include a first warp knitting yarn and a second warp knitting yarn knitted transversally and longitudinally to produce a plurality of continuous interlacing long meshes for effectively enhancing the extendibility of the warp knitting fabric structure.

6 Claims, 5 Drawing Sheets

WARP KNITTING FABRIC

FIELD OF THE INVENTION

The present invention relates to an improved two-sided warp knitting fabric having a cloth cover that can be knitted into long interlacing meshes and thus increasing the extendibility and maintaining a good retractable contractibility of the two-sided warp knitting fabric.

BACKGROUND OF THE INVENTION

To the understanding of the inventor of the present invention, the characteristics of a "Method of weaving a two-sided warp knitting fabric and its weaving structure" reside on that when a two-sided warp knitting fabric is woven by two corresponding base fabrics and a connecting thread connecting the base fabrics, at least one base fabric uses at least two base threads for the weaving, and at least one base thread other than the base thread in the tissue of the base fabric has a yarn knitting direction in front of stitching opposite to a yarn knitting direction of the foregoing base threads and connecting threads, and the yarn feed ratio of other base threads is set to over feeding for the weaving, so that the stitching direction of the base threads is directed outward.

The foregoing prior art can weave two cloth covers having no hole at all. Although such fabric has a soft and elastic texture, its extendible length is very limited.

SUMMARY OF THE INVENTION

Therefore, it is a primary objective of the present invention to provide a two-sided warp knitting fabric that adopts a yarn looping knitting method to produce longitudinal holes evenly distributed on its cloth cover and interlaced with each other, so as to achieve the effect of at least doubling the contractibility and maintaining a very good resumption after the fabric is extended.

To achieve the foregoing objective, the present invention provides a contractible two-sided warp knitting fabric structure that comprises symmetrical front and rear base fabrics which are knitted by at least two different warp knitting mechanisms, and a connecting yarn coupled to the front and rear base fabrics. The front and rear base fabrics are knitted with two different warp knitting processes. In the first warp knitting yarn process, a yam is stitched alternately left and right for seven stitches at the back of the needle for every transversal stitch, and seven stitches are skipped for a transversal stitch, and then the yarn is stitched alternately left and right for seven stitches at the back of the needle again, and the process returns to the foregoing transversal stitch position to repeating the whole process. Further, the first warp knitting yarn knitting process skips a stitch after a plurality of yarns is knitted in the same direction, and two groups of yams for the first warp knitting yarn knitting process are knitted in the opposite directions. In the second warp knitting yarn knitting process, the yarn is knitted for six stitches along a linear opening loop, and then knitted four stitches for every two loops of stitches and the foregoing process is a cycle. The connecting yarn is knitted a stitch at the back of the needle and a stitch at the front of the needle for every three stitches, so that the two-sided warp knitting fabric produced by the foregoing processes forms a plurality of continuous alternate long meshes disposed at the same position transversally and longitudinally, so as to provide a better extendibility than the contractible two-sided warp knitting fabric having no meshes.

DETAILED DESCRIPTION OF THE PREFERRED EMBODIMENTS

Figure 1:
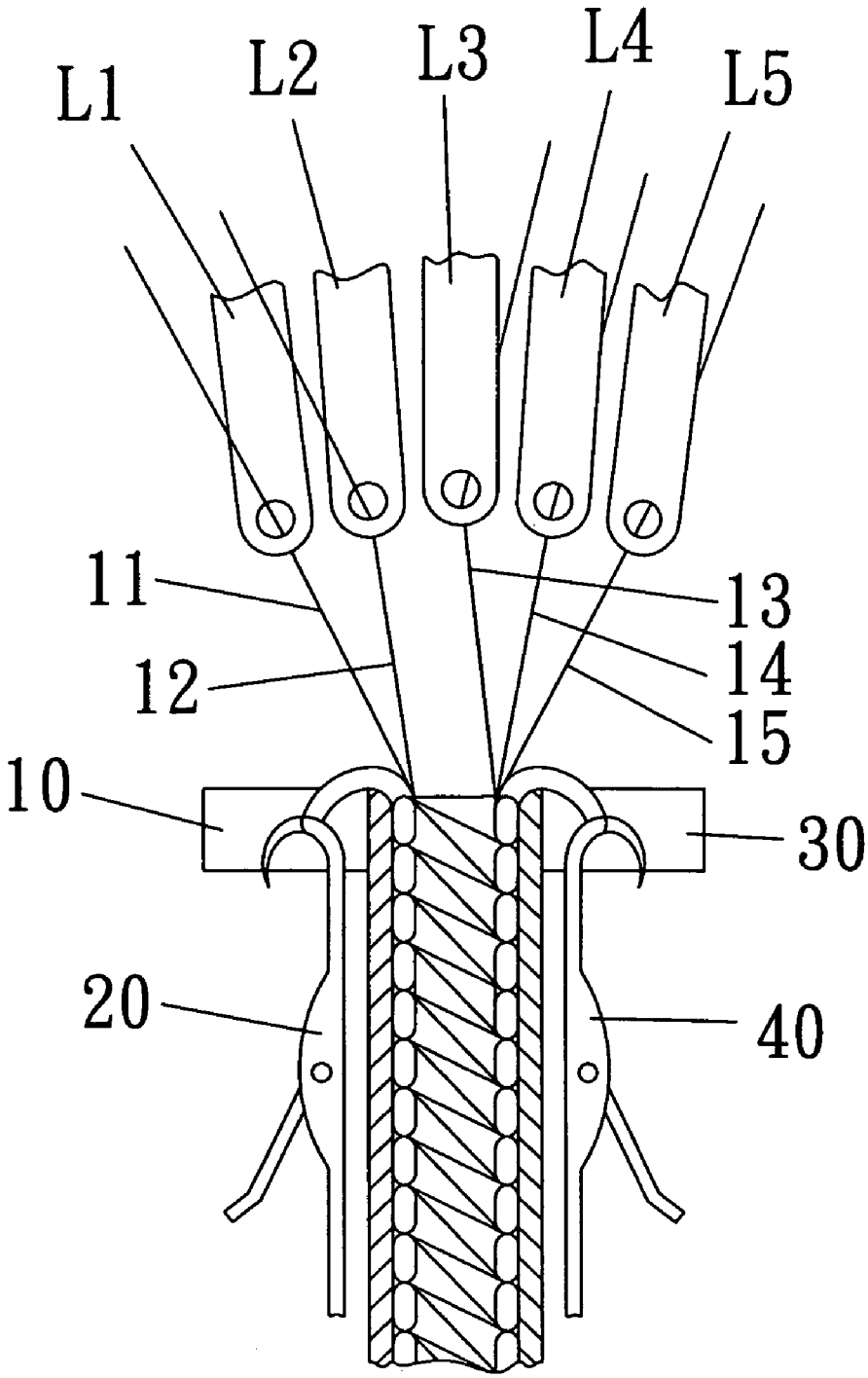
FIG. 1 is a schematic view of a warp knitting machine and a section of a two-sided warp knitting fabric according to the present invention.
Figure 2:
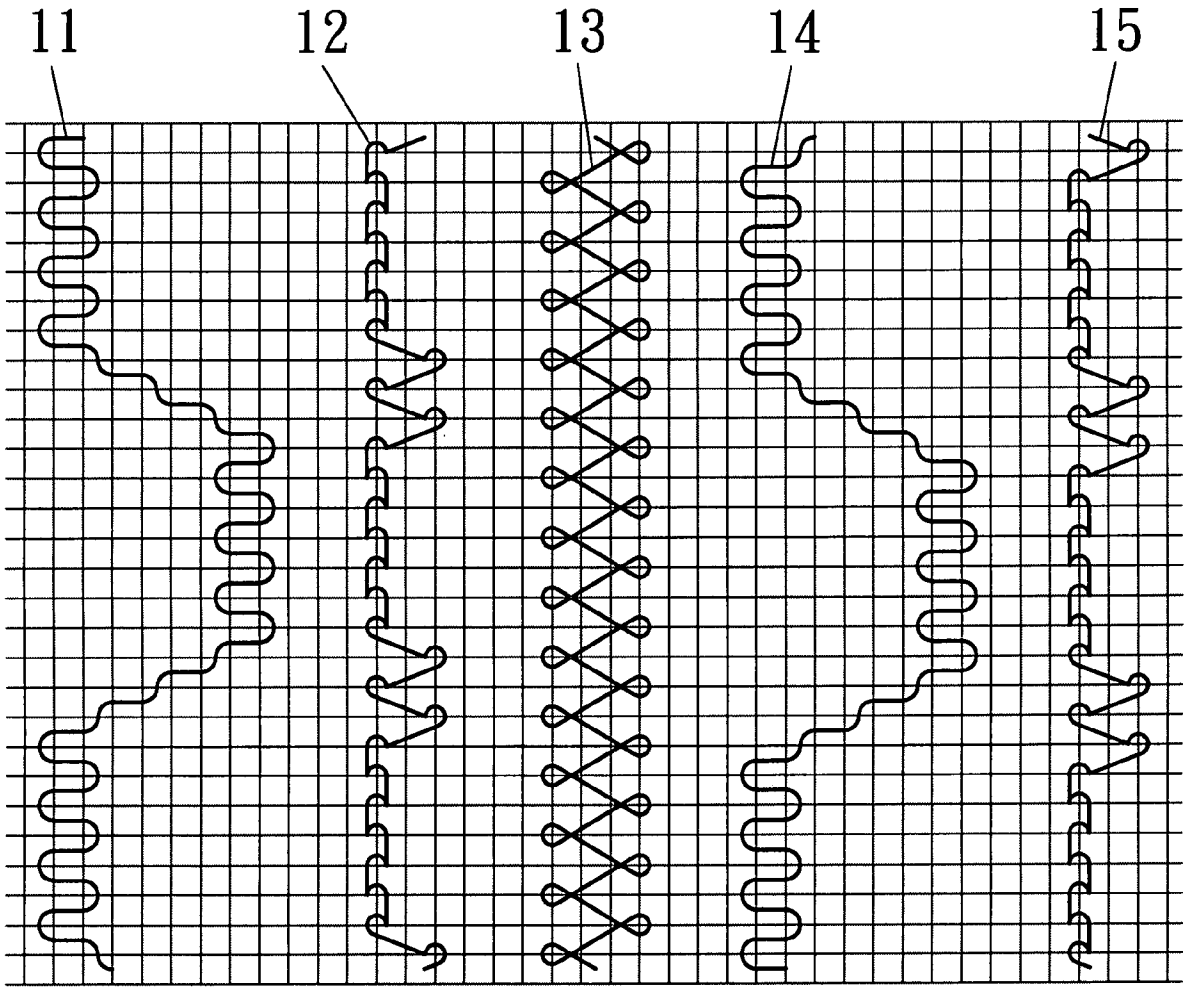
FIG. 2 is a schematic view of the disassembled parts of each yarn according to the present invention.
Figure 3:
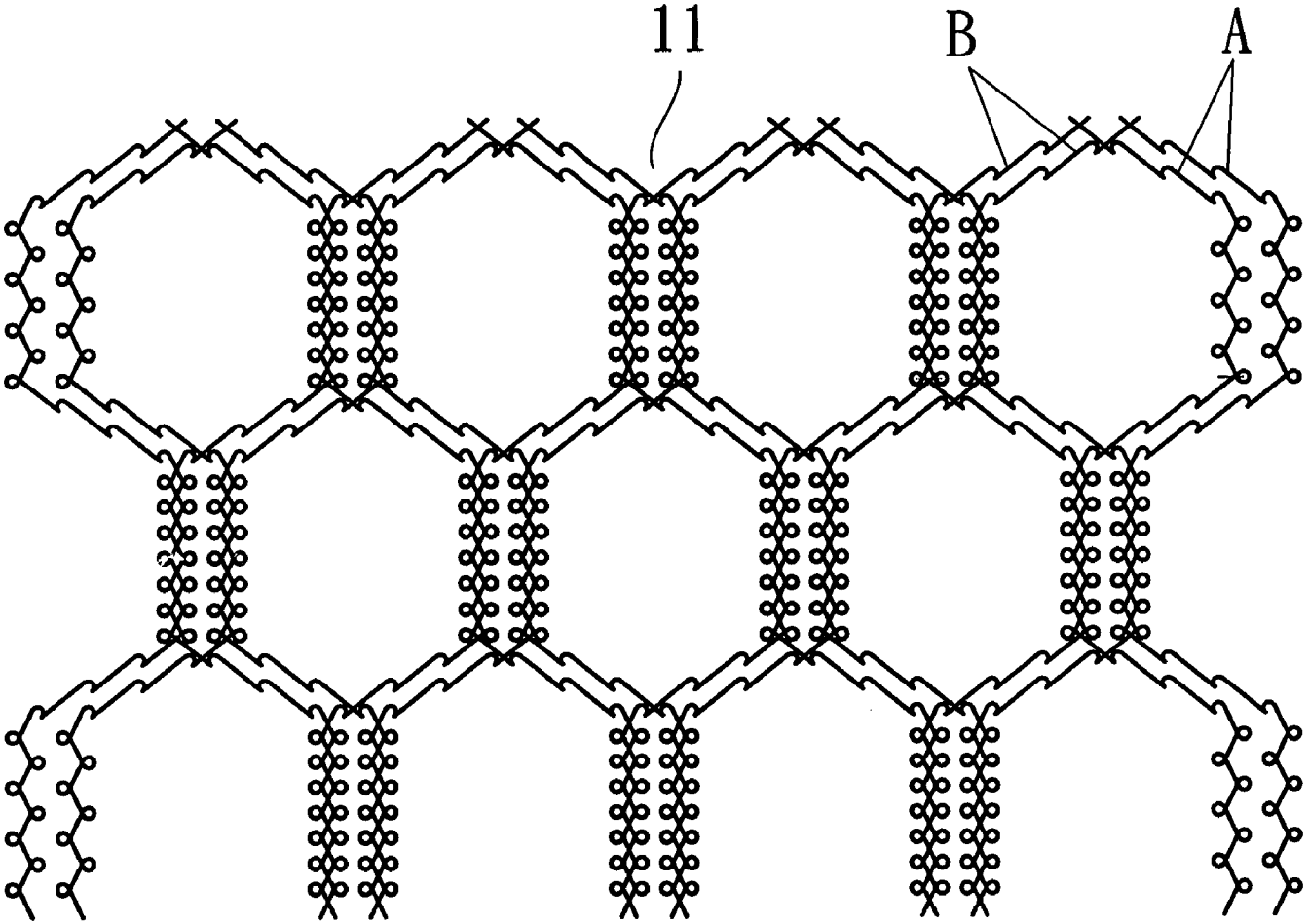
FIG. 3 is a schematic view of a first warp knitting yam on the surface of a base fabric according to the present invention.
Figure 4:
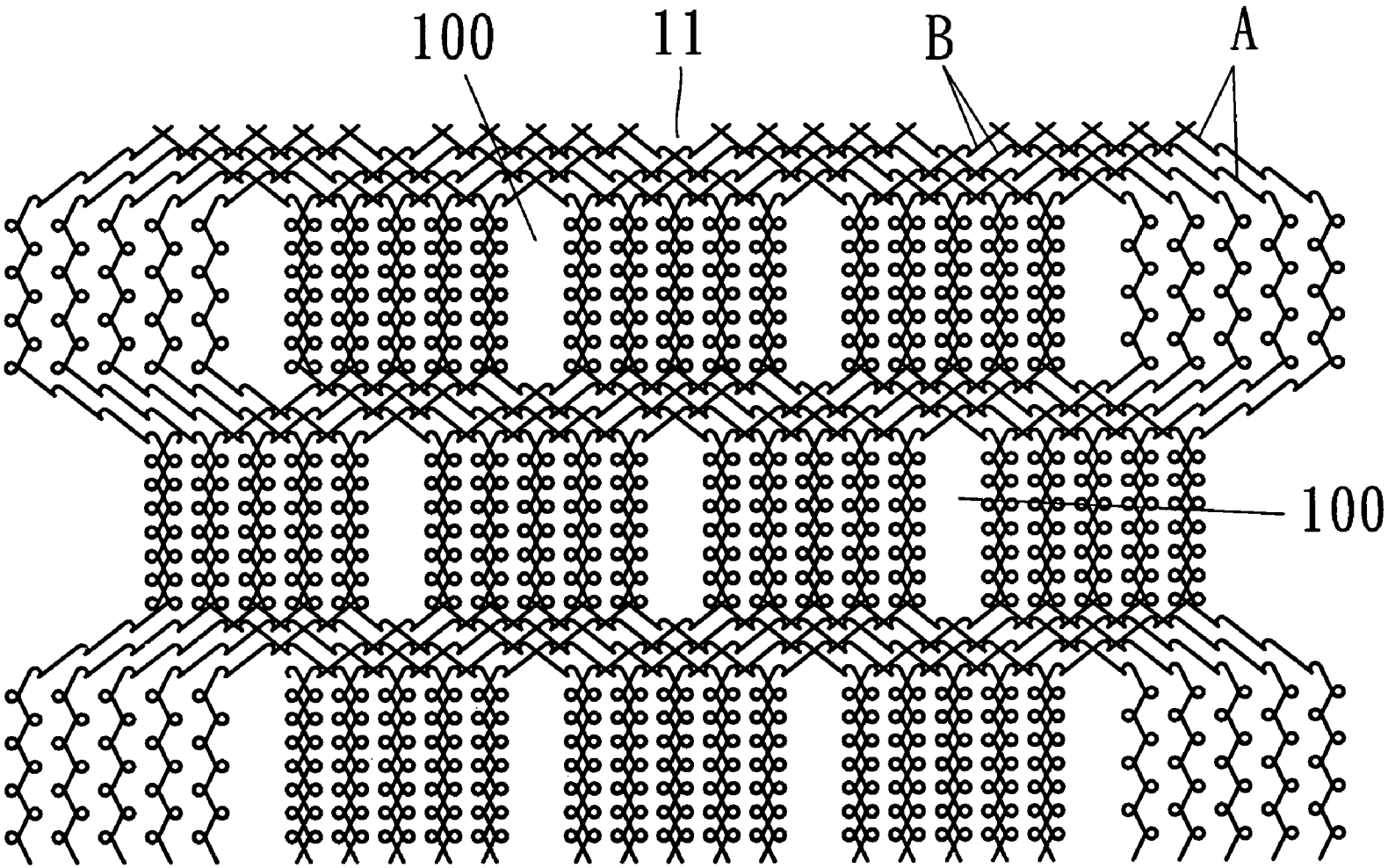
FIG. 4 is another schematic view of a first warp knitting yarn on the surface of a base fabric according to the present invention.
Figure 5:
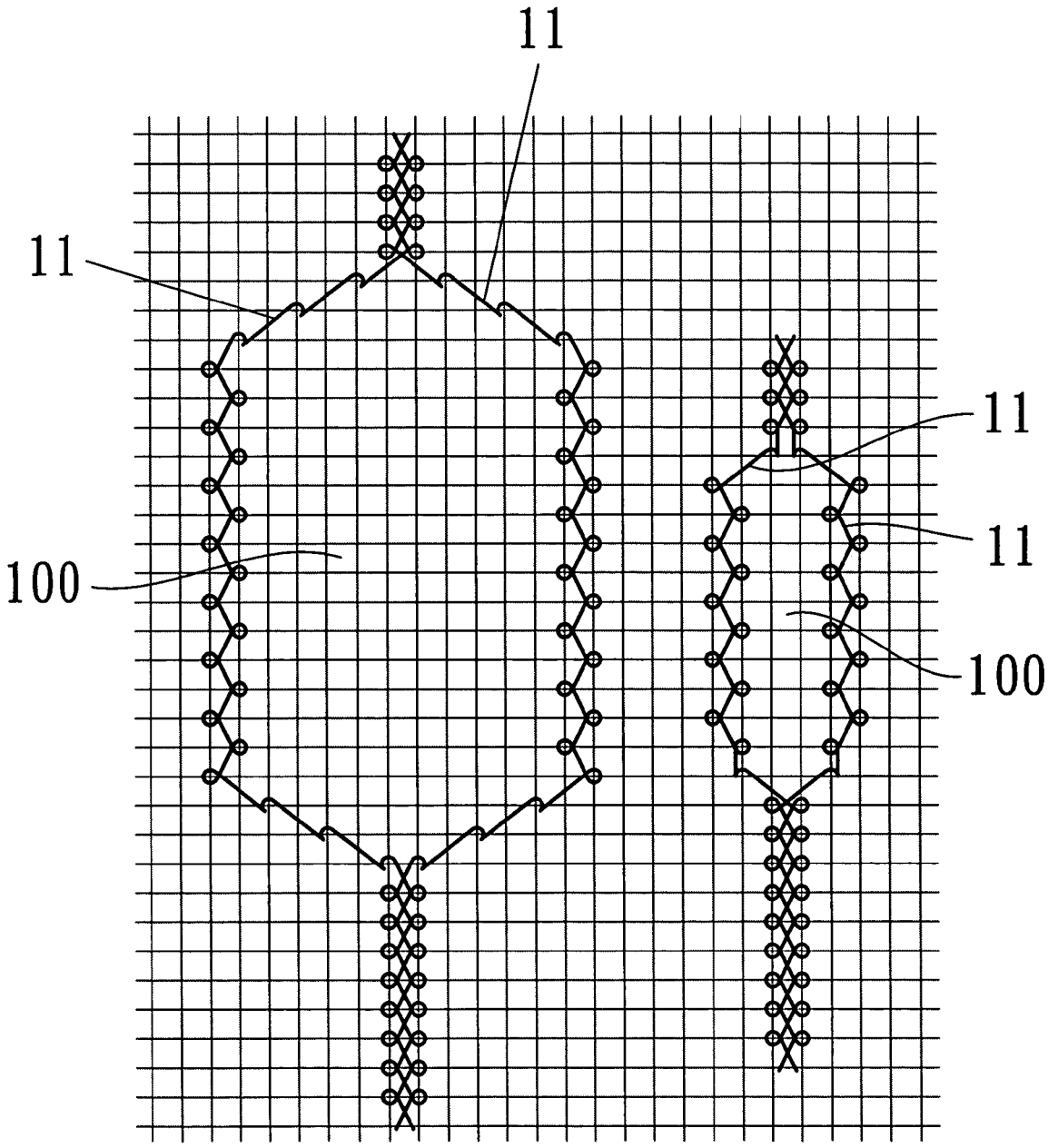
FIG. 5 is a schematic view of the tissue position of a first warp knitting yarn according to another preferred embodiment of the present invention.

Referring to FIGS. 1 and 2, a plurality of rows of yarn fingers L1, L2 is provided for passing the yarns 11, 12, and the yarn fingers L4, L5 are provided for passing the yarns 14, 15, and the yarn fingers L1, L2 form a front knitting needle row to cope with a front needle cylinder 10 and a front knitting needle 20, and the yarn fingers L4, L5 form a rear knitting needle row to cope with the rear needle cylinder 30 and a rear knitting needle 40, and the yarn fingers L3 provides the yarn 13 for knitting as the connecting yarn coupled to the front and rear base fabrics, wherein two different warp knitting processes are provided for knitting the front and rear base fabrics. In the first warp knitting yarn knitting process, the yarn 11, 14 is stitched alternately left and right for seven stitches at the back of the needle for every transversal stitch, and seven stitches are skipped for a transversal stitch, and then the yarn 11, 14 is stitched alternately left and right for seven stitches at the back of the needle again, and the process returns to the foregoing transversal stitch position for repeating the whole process. Referring to FIGS. 3 and 4 for the schematic front view of the yarn 11 constituting the front base fabric during the first warp knitting yarn weaving process, the yarn 11 is divided into two groups A, B, and the two groups A, B of the yarn 11 are knitted in the opposite symmetrical directions, and one group of the yarn 11 uses the same number of knitting rows along the same direction for every other stitch to produce a long mesh 100. In the second warp knitting yarn knitting process, the yarn 12, 15 is knitted for six stitches along a linear opening loop, and then knitted four stitches for every two loops of stitches, and the foregoing process is a cycle. The yarn 12 is used for the second warp knitting yarn knitting process of the front base fabric, and the yarn 15 is used for the second warp knitting yarn weaving process of the rear base fabric; and the yarn 14 passing through the yarn fingers 14 is the connecting yarn for connecting the front and rear base fabrics; so that the contractible two-sided warp knitting fabric produced by the aforementioned weaving process has continuous long meshes 100 alternately knitted transversally and longitudinally at the relative position of the front and rear base fabrics, and when the fabric is pulled and stretched, the alternately knitted meshes can be spread out to have a better extendibility than that of the contractible two-sided warp knitting fabric having no mesh.

Further, the first warp knitting yarn is woven by a knitting process having the number of alternate sideway stitches of the yarn 11 knitted transversally by one stitch and the number of jumping stitches varies according to a predetermine length of the long mesh 100.

While we have shown and described the embodiment in accordance with the present invention, it should be clear to those skilled in the art that further embodiments may be made without departing from the scope of the present invention.

What is claimed is:

1. A contractible two-sided warp knitting fabric structure, comprising a front base fabric, a rear base fabric, and a connecting yarn coupled with the front and rear base fabrics, and the front and rear base fabrics comprising a first warp knitting yarn and a second warp knitting yarn knitted transversally and longitudinally, the first warp knitting yarn knitting process knitting a yarn alternately left and right for seven stitches at the back of the needle for every transversal stitch, seven stitches being skipped for a transversal stitch, and the process returning to the transversal stitch position for repeating the knitting process.

2. The contractible two-sided warp knitting fabric structure as claimed in claim 1, wherein the first warp knitting yarn is knitted by a process having two sets of oppositely positioned knitting mechanisms.

3. The contractible two-sided warp knitting fabric structure as claimed in claim 1, wherein the two sets of knitting mechanisms for knitting the first warp knitting yarn produce a long mesh by knitting a plurality of knits in the same direction and then separating the knits by a stitch.

4. The contractible two-sided warp knitting fabric structure as claimed in claim 1, wherein the second warp knitting yarn knitting process knits six stitches along a linear opening loop, and then knitted four stitches for every two loops of stitches, and the process is a cycle.

5. The contractible two-sided warp knitting fabric structure as claimed in claim 1, wherein the connecting yarn is knitted a stitch at the back of a needle and a stitch at the front of the needle for every three stitches.

6. The contractible two-sided warp knitting fabric structure as claimed in claim 1, wherein the first warp knitting yarn is knitted by a knitting process that varies according to a predetermined length of the long mesh.

* * * * *